US011509990B2

(12) United States Patent
Lin et al.

(10) Patent No.: US 11,509,990 B2
(45) Date of Patent: Nov. 22, 2022

(54) HEADBAND FOR A HEADSET AND A METHOD FOR ASSEMBLY OF A HEADBAND FOR A HEADSET

(71) Applicant: GN Audio A/S, Ballerup (DK)

(72) Inventors: Frank Lin, Ballerup (DK); Seven Huang, Ballerup (DK); Jon Grane Madsen, Ballerup (DK); Bill Grane Zeng, Ballerup (DK); Jack Zhao, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 17/454,421

(22) Filed: Nov. 10, 2021

(65) Prior Publication Data

US 2022/0210533 A1 Jun. 30, 2022

(30) Foreign Application Priority Data

Dec. 30, 2020 (CN) ..... 202011621289.0

(51) Int. Cl.
*H04R 25/00* (2006.01)
*H04R 1/10* (2006.01)

(52) U.S. Cl.
CPC ..... *H04R 1/105* (2013.01); *H04R 1/1008* (2013.01)

(58) Field of Classification Search
CPC ..... H04R 1/1091; H04R 5/0335; H04R 1/10; H04R 1/105; H04R 1/1008; H04R 1/1041; H04R 1/1016; H04R 1/1058; H04R 5/033; H04R 1/1066; H04R 1/1075
See application file for complete search history.

(56) References Cited

U.S. PATENT DOCUMENTS 10,277,975 B2 * 4/2019 Monaghan ..... H04R 5/0335
2016/0277828 A1 9/2016 Oh et al.

FOREIGN PATENT DOCUMENTS

| | | |
|---|---|---|
| CN | 210469678 | 5/2020 |
| CN | 211152163 | 7/2020 |
| EP | 2566191 A2 | 3/2013 |
| WO | 2010065046 | 6/2010 |

OTHER PUBLICATIONS

Extended European Search Report, dated May 30, 2022, 8 pages, issued in corresponding European Patent Application No. 21213744.2.

* cited by examiner

*Primary Examiner* — Amir H Etesam

(74) *Attorney, Agent, or Firm* — Hamre, Schumann, Mueller & Larson, P.C.

(57) ABSTRACT

The disclosure relates to a headband for a headset, the headband comprising a first strip and a second strip detachably assembled together. The first strip comprises at least one through opening and the second strip is detachably connected via the through opening to the first strip as a cover. The second strip comprises first and second parts at least partly covering the first strip. The disclosure further relates to a headset comprising a headband and a method for assembly of a headband for a headset.

26 Claims, 9 Drawing Sheets

HEADBAND FOR A HEADSET AND A METHOD FOR ASSEMBLY OF A HEADBAND FOR A HEADSET

TECHNICAL FIELD

The present disclosure relates to a headband for a headset and a method for assembly of a headband for a headset. More specifically, the disclosure relates to a headband for a headset, a headphone and a method for assembly of a headband for a headset as defined in the introductory parts of the independent claims.

BACKGROUND ART

EP 2 566 191 A2 and US 2016/0277828 A1 disclose headphones/-sets allowing a wearer to personalize the headphones/-sets by inserting a variety of interchangeable décor strips onto a headband of the headphones/-sets.

A problem with the solutions of the prior art is that the headbands are made up of many different interconnected parts making any interchange of the headbands and their appearance complicated. There is thus a need for improved changeability of headbands for headsets.

SUMMARY

It is an object of the present disclosure to mitigate, alleviate or eliminate one or more of the above-identified deficiencies and disadvantages in the prior art and solve at least the above mentioned problem. According to a first aspect there is provided a headband for a headset or headphone, the headband being configured to carry an earcup and/or earphone, the headband comprising a first strip and a second strip detachably assembled together, wherein the first strip comprises at least one through opening and the second strip is detachably connected via at least one of the through openings to the first strip being a carrier, wherein the second strip comprises first and second parts at least partly covering the first strip, characterized in that the through opening of the first strip is configured to extend along the first strip with a varying size and/or shape and/or width from an orifice at a first end of the first strip into a slit ending closer a second end of the first strip, that the first part of the second strip has a size and/or shape and/or width adapted to fit into the orifice of the through opening when assembled thereto in a first direction (R) across the first strip, that the size and/or shape and/or width of the first part of the second strip is adapted to not fit into the slit of the through opening when assembled thereto in the first direction, and that the second part of the second strip has a size and/or shape and/or width adapted to neither fit into the orifice nor the slit of the first strip when assembled thereto to finalize the headband.

According to some embodiments, the second part of the second strip has a size and/or shape and/or width adapted to neither fit into or pass through the orifice nor the slit of the first strip when assembled thereto in the same first direction or any other direction of assembly.

According to some embodiments, the first part of the second strip of the headband covers a substantial/major part of a first surface of the first strip of the headband and the second part of the second strip covers a substantial/major part of a second surface of the first strip when the strips are assembled together as the headband, which first and second surfaces of the first strip are opposite and face away from each other.

According to some embodiments, the first and second parts of the second strip are interconnected via a third part with a size and/or shape and/or width adapted to fit into and pass through the orifice and the slit of the first strip when assembled thereto.

According to some embodiments, the third part of the second strip is configured to fit into and pass through the orifice and the slit of the first strip when assembled thereto in the first direction and a subsequent second direction along a plane of extension of the first strip.

According to some embodiments, the first part of the second strip are larger/wider than the slit but smaller than the orifice of the first strip in a plane of extension of the first and the second strip.

According to some embodiments, the second part of the second strip are larger/wider than both the orifice and the slit of the first strip in a plane of extension of the first and the second strip.

According to some embodiments, the slit of the first strip has the same width and/or size and/or shape along its length.

According to some embodiments, the slit of the first strip has a varying width and/or size and/or shape along its length.

According to some embodiments, the slit of the first strip comprises at least one protrusion narrowing down the width and/or size of the slit where the protrusion is located.

According to some embodiments, at least one of the ends of the first strip comprises a recess with an opening facing away from the first strip, which recess is made through the thickness of the first strip.

According to some embodiments, each end of the first strip comprises the recess.

According to some embodiments, each recess comprises at least one projection extending inwards towards the first strip.

According to some embodiments, each recess comprises two projections extending inwards towards the first strip.

According to some embodiments, each projection is pointed.

According to some embodiments, each projection is shaped as a pointed hook.

According to some embodiments, the slit and the orifice of the first strip of the headband are configured to extend between the first and second ends of the first strip and to end before each recess of the first strip.

According to some embodiments, the slit and/or the orifice of the first strip of the headband comprises one or more areas or sections or portions of roughness and/or unevenness and/or one or more teeth along the inner surface of the circumference being configured to be in contact with at least parts of the second strip of the headband.

According to some embodiments, the length between the ends of the slit and the orifice (i.e. the total length from where the orifice begins until the slit ends or vice versa) of the first strip of the headband is substantially the same or the same or substantially equal or equal or longer than the length of the second strip of the headband.

According to some embodiments, the first strip of the headband is made of metal, such as SUS/SAE 304 stainless steel, or plastic, such as Thermoplastic Polyurethane (TPU) or Polyamide/Nylon (PA), or wood or a composite material or made of a combination of one or more or any of those materials. Hence, the surface of the first strip is easily covered and/or the clamping force of the headband against the head of a user easily adjusted According to some embodiments, the second strip is made of plastic, such as Thermoplastic Polyurethane (TPU) or Polyamide/Nylon (PA) or Thermoplastic Elastomer (TPE)

or natural or artificially made rubber, or wood or a composite material or fabric or made of a combination of one or more or any of those materials. Hence, the second strip is able to be moulded in a plastic material for easy assembly and threading of its first part/surface through the first strip while the lower part/surface is sufficiently "soft" for better padding and comfort against the head of the wearer of the headband. Hence, the second strip is able to be moulded in two or more different plastic materials, i.e. via two-component molding, where for example its upper part/surface is molded in one plastic for easier assembly and threading through the first strip and the lower part/surface is molded in another plastic material, such as a "softer" one for better padding and comfort against the head of the wearer of the headband According to a second aspect there is provided a headset comprising a headband according to any of the preceding claims, wherein the headband is detachably connected with one end to only an earphone speaker or the headband is detachably connected with one end to an earphone speaker and an earphone microphone or the headband is detachably connected with one end to a head support.

According to some embodiments, the second part of the second strip has a breadth or width being smaller or narrower or substantially the same or equal or the same or equal or larger or wider than the breadth or width of the first strip in a plane of extension of the first and the second strip. The plane of extension of the first and the second strip being substantially the same or the same or the plane of extension of the first strip is substantially in parallel or in parallel with the plane of extension of the second strip.

According to some embodiments, the width of the second part of the second strip is at least 5% smaller or narrower or at least 1% to 400% larger or wider than the breadth or width of the first strip in a plane of extension of the first and the second strip. The plane of extension of the first and the second strip being substantially the same or the same or the plane of extension of the first strip is substantially in parallel or in parallel with the plane of extension of the second strip.

According to some embodiments, the width of the second part of the second strip is at least 1% to 400% larger or wider than the breadth or width of the first strip in a plane of extension of the first and the second strip along at least a longitudinal section of the second strip, which longitudinal section is configured to be born against the head of a user of the headband when the first and the second strip are assembled together making up the headband. The plane of extension of the first and the second strip being substantially the same or the same or the plane of extension of the first strip is substantially in parallel or in parallel with the plane of extension of the second strip.

According to a third aspect there is provided a method for assembly of a headband for a headset, the method comprising assembling the headband by assembling a first strip and a second strip detachably together via at least one through opening of the first strip by detachably connecting the second strip to the first strip via the at least one through opening to at least partly cover the first strip with first and second parts of the second strip of the headband when the headband is assembled, characterized by aligning the first part of the second strip with an orifice of the through opening of the first strip at a first end of the first strip, moving the second strip in a first direction across the first strip such that the first part of the second strip is moved into the orifice and through the orifice and the through opening in the first direction and into a slit ending closer a second end of the first strip, and moving the second strip in a subsequent second direction along the first strip along the slit until the end of the slit with the first part of the second strip moving along and over a first side of the first strip while, at the same time, moving the second part of the second strip along and over a second side of the first strip until the end of the slit is reached finalizing the assembly of the headband.

According to some embodiments, the method comprises moving the first part of the second strip of the headband along and over the first side of the first strip of the headband being opposite the second side of the first strip, which opposite and second side the second part of the second strip of the headband is moving over and along simultaneously and in parallel with the first part of the second strip until the assembly of the two strips together as the headband is finished.

Effects and features of the second and third aspects are to large extent analogous to those described above in connection with the first aspect. Embodiments mentioned in relation to the first aspect are largely compatible with the second and third aspects and any embodiments related thereto, such as moving the second strip past projections and/or teeth of the slit and/or providing an optimized friction between the first and the second strip that simplifies assembly therebetween while, at the same time, securing sufficient holding of the second strip in the first strip to keep the integrity of the headband intact after being assembled.

In some embodiments, the following advantage(s) is/are provided: easy assembly of the second strip to the first strip into the whole headband; more tight and secure attachment of the second strip to the first strip of the headband with less risk or even no risk in coming or sliding off after assembly and after assembling the two strips into the headband, also a more tight and secure assembly of the headband itself to the headset(s) is provided; easy adjustment of the clamping force of the headband being conformed to the head of the user of the headset enabling improved control of the required clamping force; low or decreased deviation of the clamping force of the headband being conformed to the head of the user of the headset enabling better control of the desired clamping force; reduced number of parts for making up the headband; reduced and saved amount of material by optimizing the use of material required for making the headband; reduced or even eliminated risk of hurting any body parts, such as fingers and hands when assembling the headband as the pointed projections are directed inwards and towards the first strip and not outwards; reduced and saved amount of material required for making the headband as any parts connected to the ends of the headband, such as an earphone speaker and/or head support member or the like can be optimized or reduced in size as the ends of the first strip is thinner or not as wide as prior art ones, and reduction of the number of parts for making up the whole headband as only one part, i.e. the second strip forms both the support surface and padding to be worn and born against the head of the user of the headband and the upper and opposite surface that is exposed outwards at/on the wearers head when the headband is worn.

The present disclosure will become apparent from the detailed description given below. The detailed description and specific examples disclose preferred embodiments of the disclosure by way of illustration only. Those skilled in the art understand from guidance in the detailed description that changes and modifications may be made within the scope of the disclosure. Hence, further objects and features of the present invention will appear from the following definitions of aspects/examples/embodiments thereof. Furthermore, as the headband of the present disclosure has two ends of which each end is configured to be connected to different accessories of headsets, such as earcups and/or speakers and/or microphones and/or head supports, each headband enables for a headset to be easily assembled into a mono or stereo ear-/headphone or a mono or stereo headset or be changed from a mono or stereo headset to a mono or stereo ear-/headphone or vice versa or be changed from a stereo ear/-headphone to a mono ear-/headphone or vice versa or its head support and speaker combined with or without microphone could easily change place, if desired.

Hence, it is to be understood that the herein disclosed disclosure is not limited to the particular component parts of the device described or steps of the methods described since such device and method may vary. It is also to be understood that terminology used herein is for purpose of describing particular embodiments only and is not intended to be limiting. It should be noted that, as used in the specification and the appended claim, the articles "a", "an", "the", and "said" are intended to mean that there are one or more of the elements unless the context explicitly dictates otherwise. Thus, for example, reference to "a unit" or "the unit" may include several devices, and the like. Furthermore, words like "comprising", "including", "containing" and similar wordings does not exclude other elements or steps.

BRIEF DESCRIPTIONS OF THE DRAWINGS

The above objects, as well as additional objects, features and advantages of the present disclosure, will be more fully appreciated to those skilled in the art by reference to the following illustrative and non-limiting detailed description of example embodiments of the present disclosure, when taken in conjunction with the accompanying drawings.

DETAILED DESCRIPTION

Figure 1:
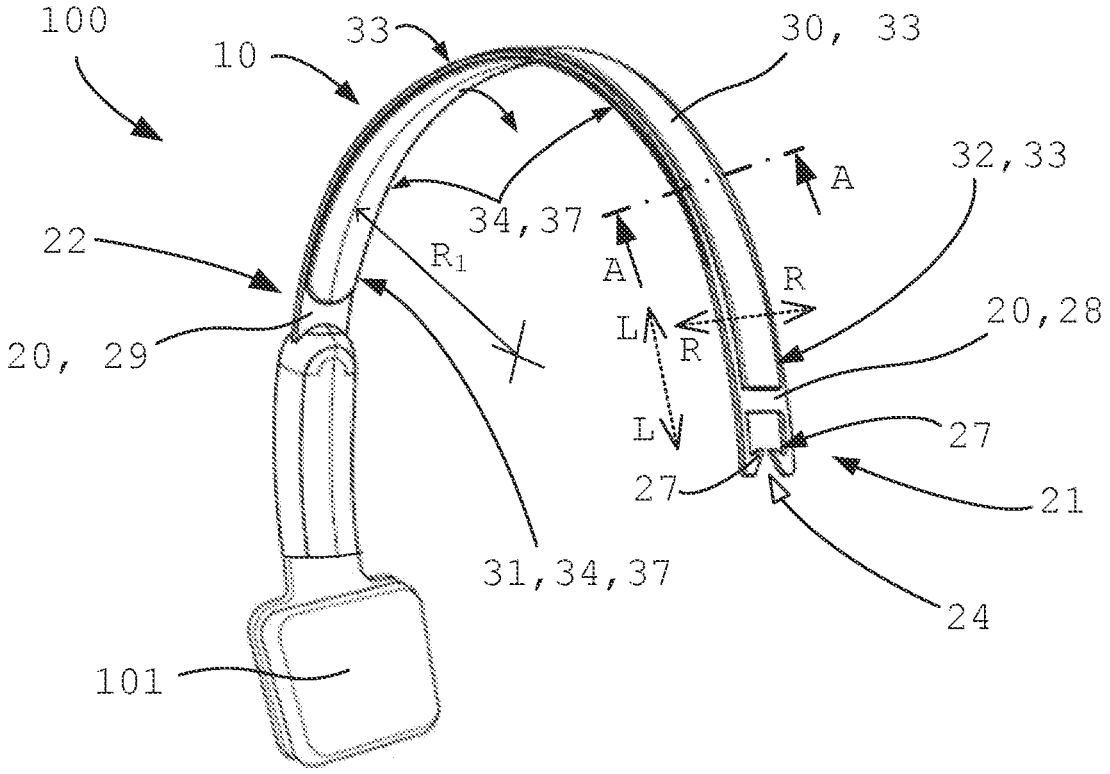
FIG. 1 shows a perspective view of an example headset not fully assembled with only an earphone speaker attached to one end of a headband and no accessory or part connected to the other end of the headband according to an embodiment of the present disclosure.

The present disclosure will now be described with reference to the accompanying drawings 1 to 8B, in which preferred example embodiments of the disclosure are shown. The disclosure may, however, be embodied in other forms and should not be construed as limited to the herein disclosed embodiments/examples. The disclosed embodiments are provided to fully convey the scope of the disclosure to the skilled person. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiment/-s even if not so illustrated, or if not so explicitly described. Throughout, the same reference numerals are used for identical or corresponding parts.

FIG. 1 shows an exemplary headset 100 comprising a headband 10. Here, the headset 100 is partly assembled with one earphone speaker 101 to the left in the FIG. but the earphone speaker could also be assembled to the left in FIG. 1. Optionally, a second earphone speaker is in some embodiments assembled to the headset 100 at the other side.

Figure 2:
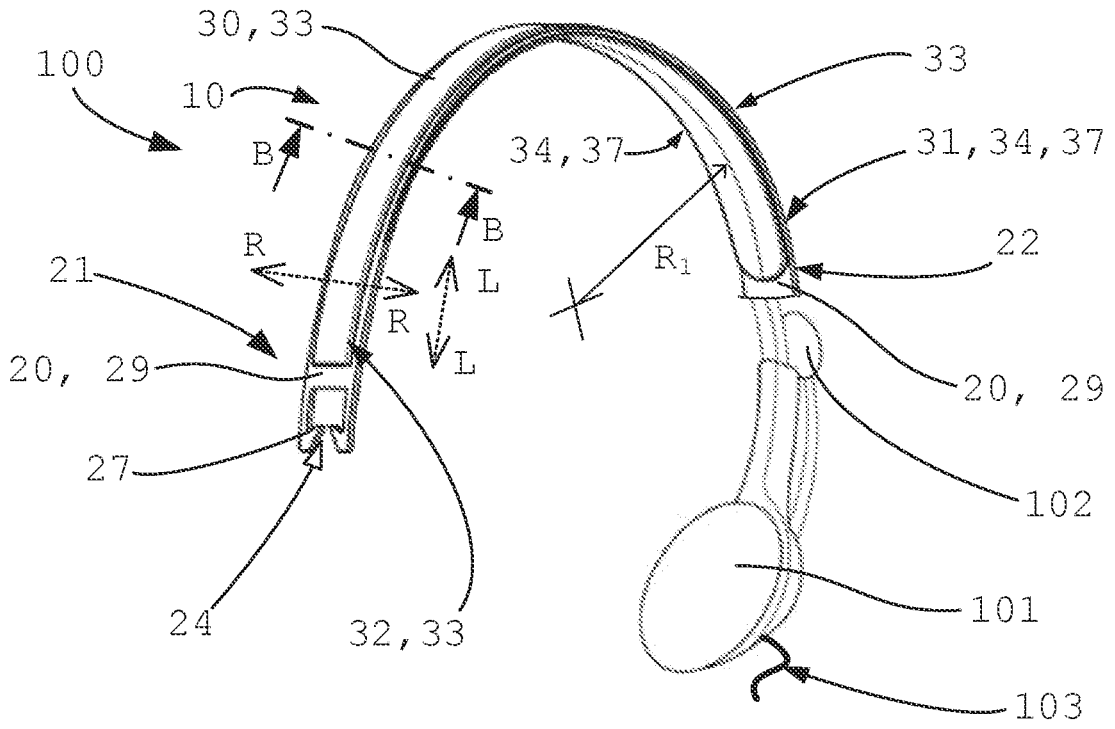
FIG. 2 shows a perspective view of an example headset not fully assembled with only an earphone speaker and a microphone attached to one end of a headband and no accessory or part connected to the other end of the headband according to an embodiment of the present disclosure.

FIG. 2 shows an exemplary headset 100 comprising a headband 10. Here, the headset 100 is partly assembled with one earphone speaker 101 and one microphone 102 and a wire 103 to the right but could in other embodiments have one or more of those entities 101, 102, 103 assembled to the left. In the shown embodiment, the wire(s) 103 could be eliminated making the headset 100 wireless. The embodiment shown in FIG. 1 is a wireless headset 100 but could in other embodiments be provided with one or more wires 103.

In some embodiments, the headband 10 is strip-shaped and comprises two parts or strips 20, 30 detachably assembled together. In some embodiments, the headband 10 is conformed to fit to a user's head, e.g. by being bent accordingly after manufacture or assembly of its two strips 20, 30 or the two strips of the headband are manufactured by moulding or the like into a corresponding but pre-bent shape. In some embodiments, the headband 10 of the present disclosure is a two-piece headband. In some embodiments, the headband 10 of the present disclosure is made up of only two separate strips 20, 30 as a two-piece headband.

Figure 3A:
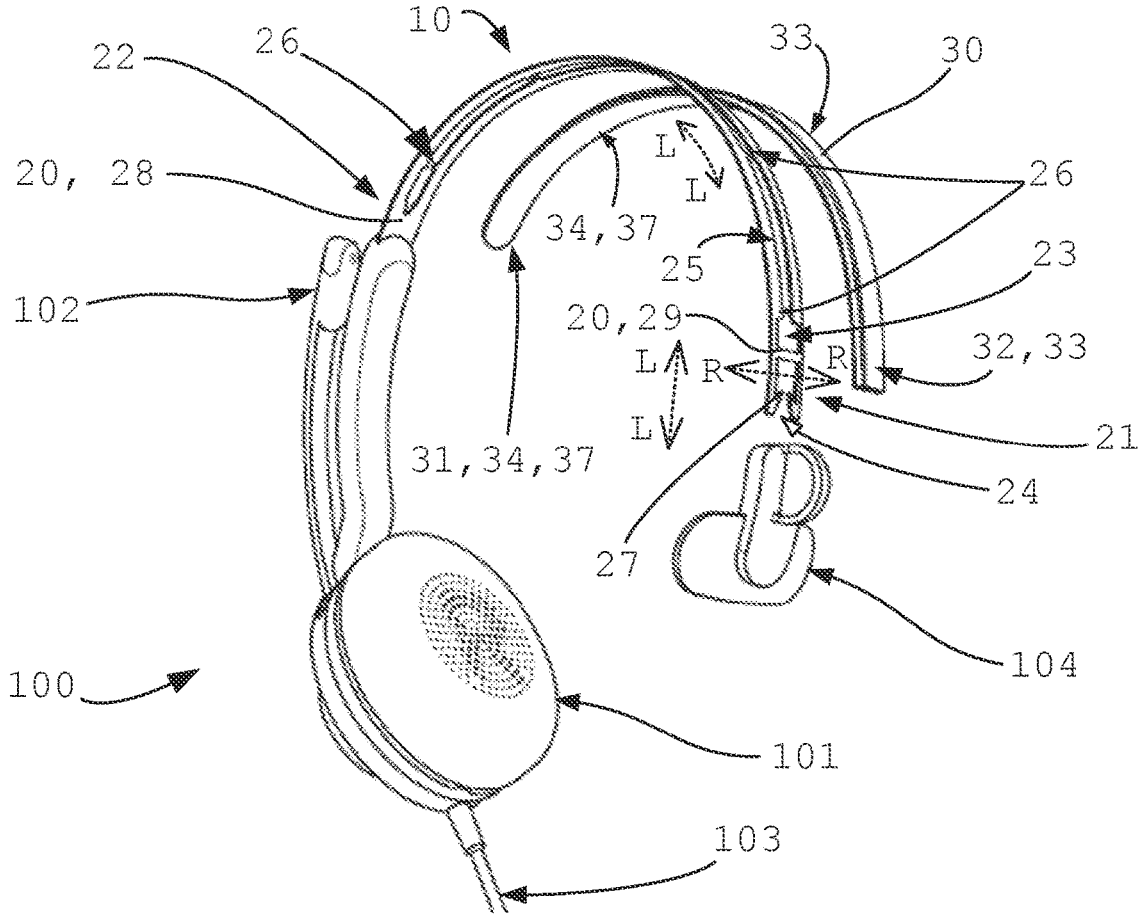
FIG. 3A shows in perspective an exploded view of an example headset with earphone speaker and a microphone attached to one end of a headband and a T-bar like head support connected to the other end of the headband before assembly or after disassembly of the two parts or strips making up the whole headband when assembled together according to an embodiment of the present disclosure.

FIG. 3A shows an exemplary headset 100 before or during assembly or after disassembly. Here, the headset 100 is partly assembled with one earphone speaker 101 and one microphone 102 and a wire 103 to the left while a T-shaped head support 104 to the right is not yet connected or just removed from the headband 10 and/or its strips 20, 30. These entities 101, 102, 103 and 104 could change sides of the headband 10 or the headset 100 could be equipped with only the earphone speaker 101 and not the microphone.

In FIGS. 1 to 4 and 6 to 8B, a first aspect of this disclosure with the headband 10 for an ear-/headphone or a headset 100 is shown. The headband 10 is strip-shaped. The headband 10 comprises a first strip 20 and a second strip 30 detachably assembled together as shown in FIGS. 1, 2, 3B, 3C, and 6 to 6D and 7. The first strip 20 of the headband 10 works as a carrier and is shown partly in FIGS. 1, 2, 3B and 3C; to somewhat greater extent in FIGS. 3A, and 4; in cross-section in FIGS. 6 to 6D and 7, and fully exposed from one side in FIGS. 8A and 8B. The first strip 20 of the headband 10 comprises at least one through opening 23, 24 and 25 (see FIGS. 3A, 4 to 4B, 8A and 8B). The second strip 30 is detachably connected via one of the through openings 23, 25 to the first strip 20 as a cover or padding (see FIGS. 1, 2, 3B, 3C, 6 to 6D and 7). The second strip 30 comprises first and second ends 31, 32 and first and second parts 33, 34 at least partly covering the first strip 20 (see FIGS. 1-4, 6 to 6D and 7). In some embodiments, the second strip 30 comprises a third part 35 interconnecting the first and second parts 33, 34 as a middle or waist portion or section making the cross-section of the second strip 30 into a H-shape (see FIGS. 6 to 6D and 7). The through opening 23, 25 of the first strip 20 extends along the first strip with a varying size from an orifice 23 transiting into a slit 25 (see FIGS. 3A, 4 to 4B, 8A and 8B). The first part 31, 33 of the second strip 30 has a size and/or width $W_1$ adapted to fit into the width W of the orifice 23 of the through opening of the first strip 20 but not into the width S of the slit 25 of the through opening of the first strip when assembled thereto in a first direction R across the plane of extension of the first strip (see FIGS. 3A, 4 to 4B, 6 to 6D, 7, 8A and 8B). The second part 32, 34 of the second strip 30 has a size and/or width $W_2$ adapted to neither fit into the orifice 23 nor the slit 25 of the first strip 20 when assembled thereto. The first strip 20 has a size and/or width $W_3$ that in some embodiments corresponds to or is smaller or larger than the width $W_1$ of the first part and/or end 31, 33 of the second strip 30 (see FIGS. 4 to 4B, 6 to 6D, 7, 8A and 8B). The first strip 20 has a size and/or width $W_3$ that in some embodiments corresponds to or is smaller or larger than the width $W_2$ of the second part and/or end 32, 34 of the second strip 30 (see FIGS. 4 to 4B, 6 to 6D, 7, 8A and 8B). The first strip 20 has a thickness $T_3$ that in some embodiments corresponds to the thickness $T_1$ of the first part and/or end 31, 33 of the second strip 30 and/or corresponds to the thickness $T_2$ of the second part and/or end 32, 34 of the second strip (see thicknesses visualized by open double arrows in FIGS. 6 to 6D and 7). The first strip 20 has a thickness $T_3$ that in some embodiments is smaller or larger than the thickness $T_1$ of the first part and/or end 31, 33 of the second strip 30 and/or is smaller or larger than the thickness $T_2$ of the second part and/or end 32, 34 of the second strip (see FIGS. 6 to 6D and 7).

Figure 6:
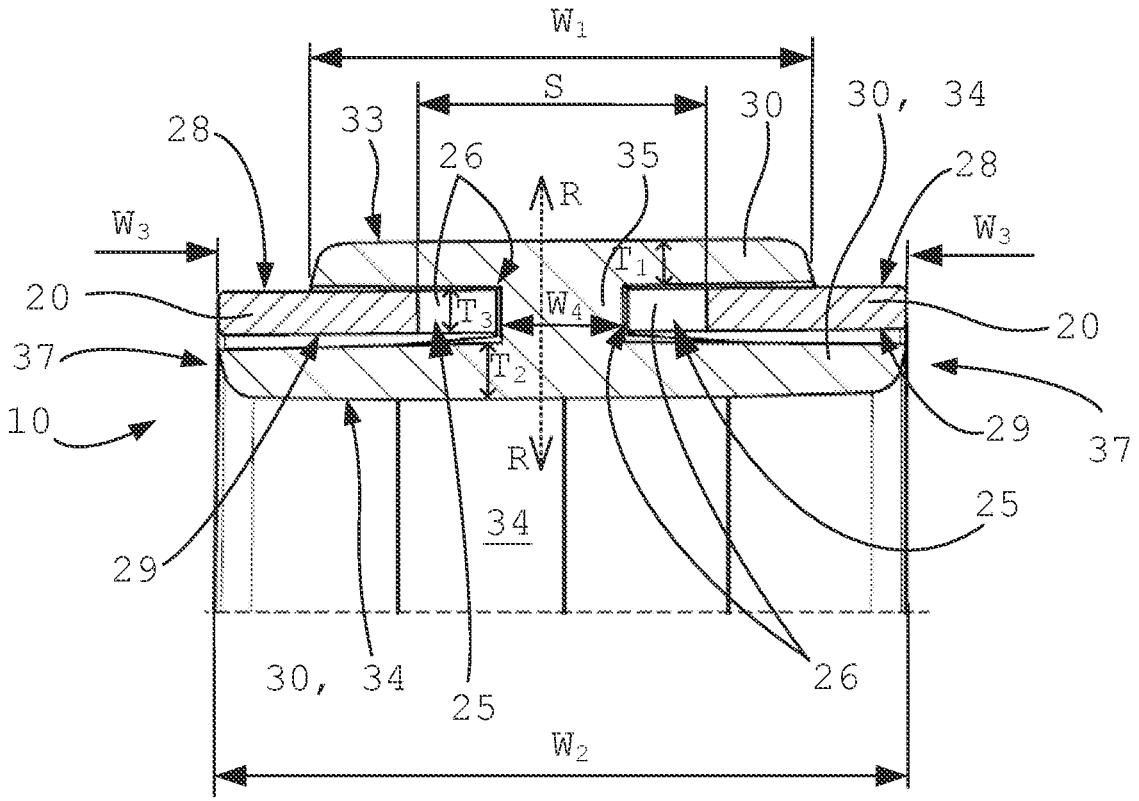
FIGS. 6, 6A, 6D and 7 show views in cross-section along line A-A in FIG. 1 or line B-B in FIG. 2 across example headbands after assembly or before disassembly of the two parts or strips making up the whole headband according to embodiments of the present disclosure.
Figure 6A:
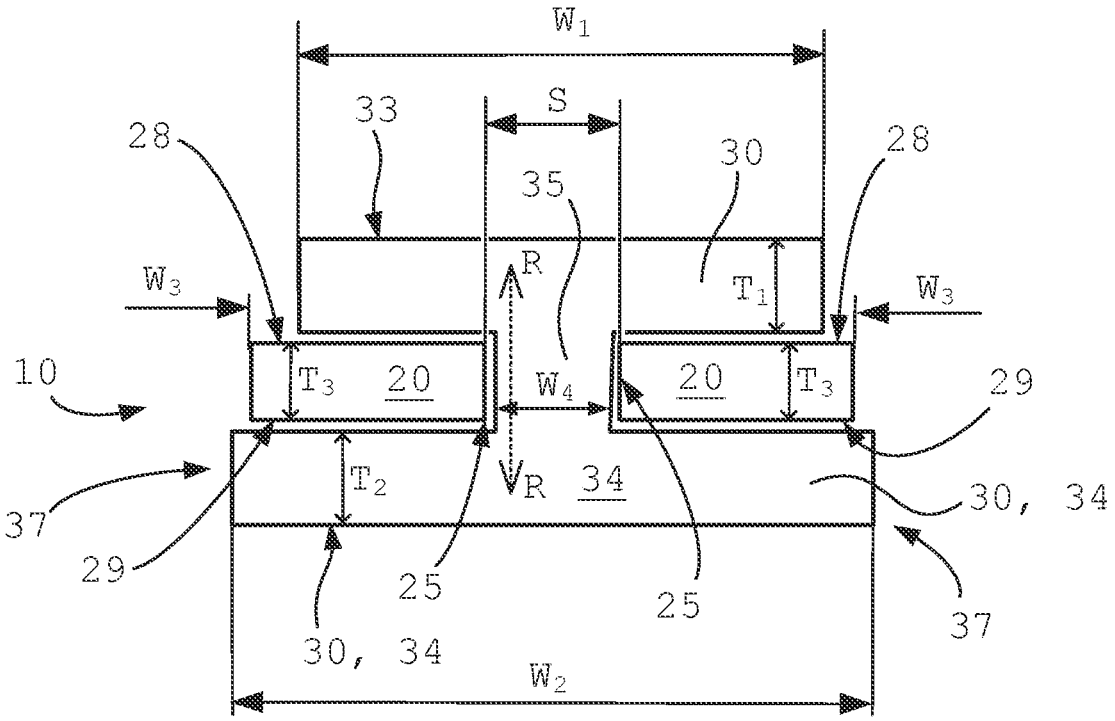
Figure 6B:
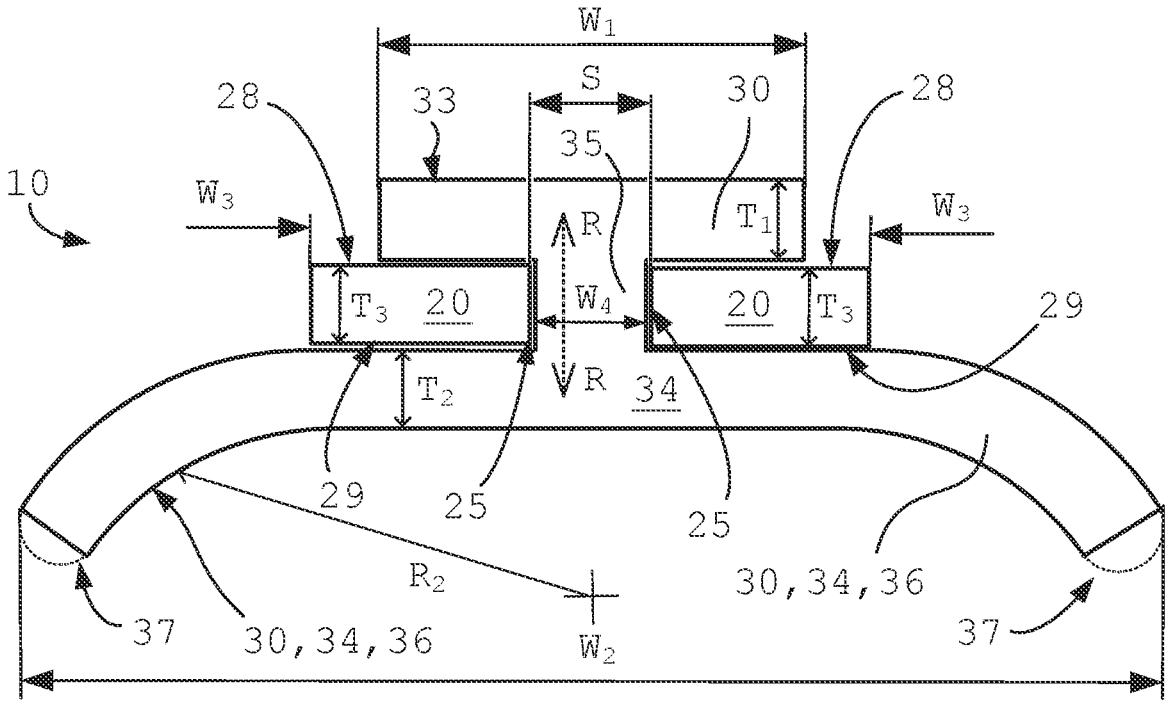
FIGS. 6B and 6C show views in cross-section along line C-C in FIG. 3C across example headbands after assembly or before disassembly of the two parts or strips making up the whole headband according to embodiments of the present disclosure.
Figure 6C:
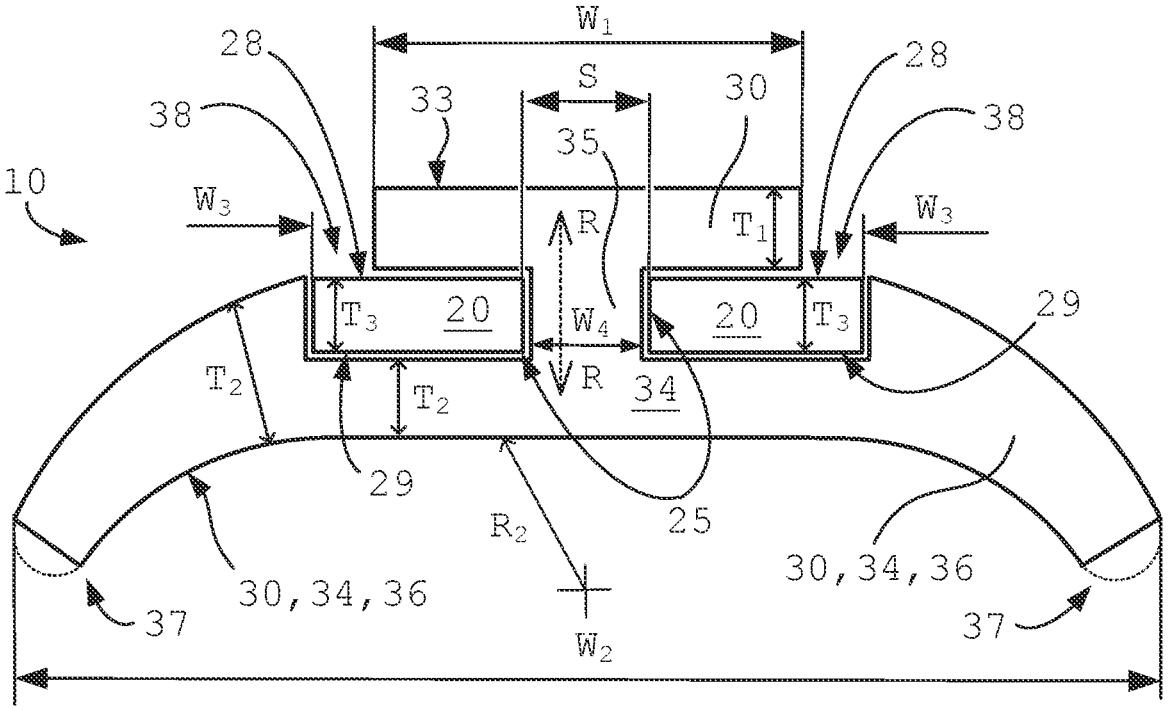
Figure 6D:
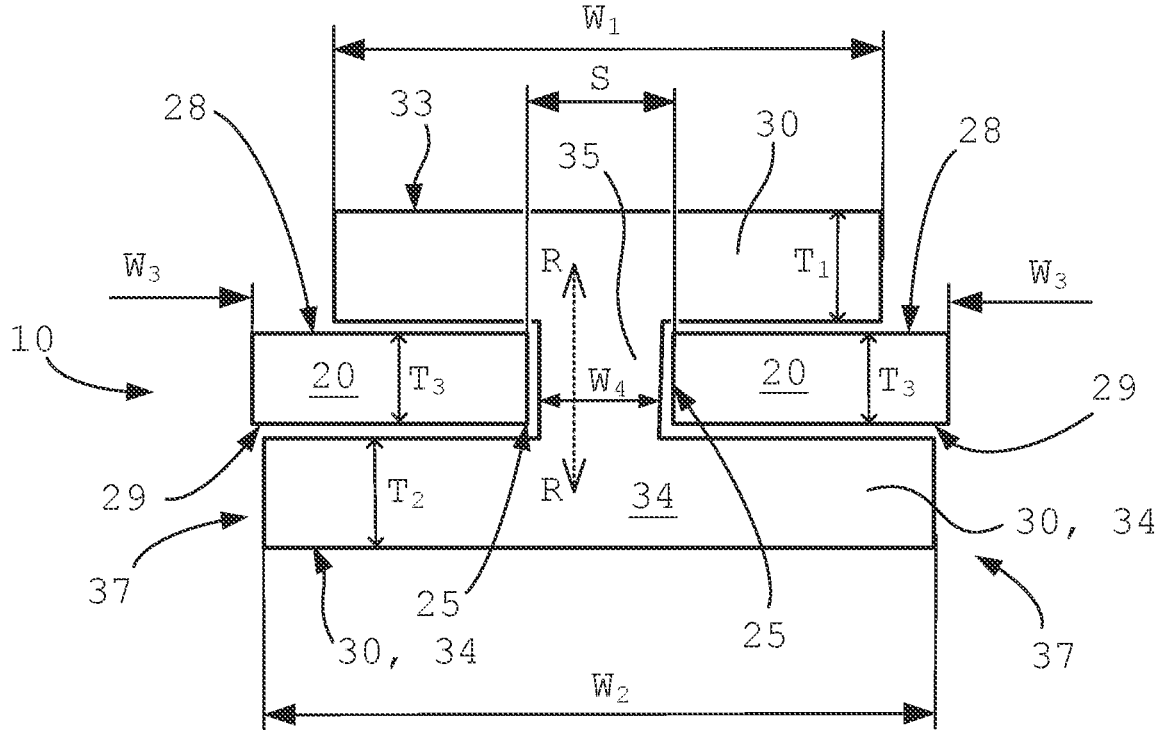

In some embodiments, the second part 34 of the second strip 30 has a varying thickness $T_2$ (see FIGS. 6B and 6C). In some embodiments, the second part 34 of the second strip 30 has a varying thickness $T_2$ (see FIG. 6C) that increases from outer edges 37 towards the intermediate or middle section 35. In some embodiments, the second part 34 of the second strip 30 has a varying shape and thickness $T_2$ (see FIG. 6C) from outer edges 37 towards the intermediate or middle section 35 forming two grooves or channels 38 extending along the length of the second strip, which grooves 38 are configured to receive the first strip 20 fully or partly. In some embodiments, the second part 34 of the second strip 30 has a varying shape and thickness $T_2$ (see FIGS. 6 to 6D) from outer edges 37 towards the intermediate or middle section 35 forming two grooves or channels 38 extending along the length of the second strip, which grooves 38 are configured to receive the first strip 20 fully from at least three of its sides where one inner side is formed and enclosed by the intermediate section 35 making the first surface 28 of the first strip flush with the upper surface of the second part 34 of the second strip (i.e. thickness $T_3$ of the first strip 20 is fully received in the grooves 38 of the second strip here, and thickness $T_3$ is substantially equal or equal to the depth of the grooves, but could in other embodiments extend above the orifices of the grooves 38 or end below the orifices of the grooves). In some embodiments, the second part 34 of the second strip 30 has a varying shape and thickness $T_2$ (see FIG. 6C) from outer edges 37 towards the intermediate or middle section 35 forming two grooves or channels 38 extending along the length of the second strip, which grooves 38 are configured to receive the first strip 20 fully or to enclose the first strip at least partly or almost fully from at least four of its sides (where one inner side is formed and enclosed by the intermediate section 35) i.e. making the first surface 28 of the first strip flush with the upper surface of the second part 34 of the second strip (i.e. thickness $T_3$ of the first strip 20 is fully received in the grooves 38 of the second strip here, and thickness $T_3$ is substantially equal or equal to the depth of the grooves, but could in other embodiments extend above the orifices of the grooves 38 or end below the orifices of the grooves). In all embodiments of FIGS. 6 to 6D, the first and second parts 33, 34 of the second strip 30 encloses the first strip 20 at least partly and more or less from at least two sides of the first strip. In the embodiment of FIG. 6D, the second strip 30 encloses less of the first strip 20.

The orifice 23 of the first strip 20 has a size and/or width W corresponding to the width $W_1$ of the first part and/or end 31, 33 of the second strip 30 (see FIGS. 4 to 4B, 6 to 6D, 7, 8A and 8B). In some embodiments, the third part 35 of the second strip 30 has a size and/or shape and/or width $W_4$ adapted to fit into and pass through the orifice 23 and the slit 25 of the first strip 20 when assembled thereto. The first and second parts 33, 34 of the second strip 30 form exposed upper and lower sides or surfaces of the headband 10 alone (if fully covering the first strip 20, i.e. $W_1 \geq W_3$ or $W_1 \approx W_3$ or $W_2 < W_3$ or $W_2 \approx W_3$) or at least partly together with first and/or second surfaces 28, 29 of the first strip 20 (if the second strip 30 only partly covers the first strip, i.e. $W_1 < W_3$ or $W_1 \approx W_3$ or $W_2 < W_3$ or $W_2 \approx W_3$) when assembled together, see FIGS. 1, 2, 3A to 3C, 4 to 4B, 6 to 6D and 7.

In some embodiments, see FIGS. 4 to 4B, 8A and 8B, the through opening with the orifice 23 and the slit 25 of the first strip 20 has a varying size and/or shape and/or width S, W extending from the orifice 23 at a first end 21 of the first strip into the slit 25 ending at and/or closer to a second end 22 of the first strip. In some embodiments, see FIGS. 8A and 8B, the orifice 23 of the first strip 20 has squared and rounded inner corners, but could in other embodiments be provided with only squared inner corners shown in dotted lines in FIG. 8B. However, rounder inner corners of the orifice 23 is of advantage when fitting in or introducing the second strip 30 into the slit 25 of the first strip 20 as the slit then is easier hit.

In some embodiments, see FIGS. 1, 2, 3A, 3B and 3C, the first and second parts 33, 34 of the second strip 30 has substantially the same or equal length or the same or equal length. In some embodiments, the first end 31 and the first part 33 of the second strip 30 are aligned in the longitudinal direction of the second strip 30, i.e. the first end 31 and the first part 33 ends or starts at/in the same location/position. In some embodiments, the second end 32 and the second part 34 of the second strip 30 are aligned, i.e. the second end 31 and the second part 34 ends or starts at/in the same location/position. In some embodiments, the first end 31 and the first part 33 of the second strip 30 are not aligned in the longitudinal direction of the second strip, i.e. its first end 31 and first part 33 are displaced lengthwise relative each other, i.e. the first end or the first part ends or starts at/in a different/another location/position. In some embodiments, the second end 32 and the second part 34 of the second strip 30 are not aligned in the longitudinal direction of the second strip, i.e. its first end 31 and first part 33 are displaced lengthwise relative each other, i.e. the first end or the first part ends or starts at/in a different/another location/position.

In some embodiments, see FIGS. 1, 2, 3A, 3B and 4, the second strip 30 is provided with a rounded first end 31 and a straight cut second end 32 (the rounded shape of the first end 31 facilitates threading this end into the orifice 23 of the first strip 20). In some embodiments, the second end 32 of the second strip 30 is rounded. In some embodiments, the first part 33 and the second part 34 at the first end 31 of the second strip 30 are rounded. In some embodiments, the first and second parts 33, 34 at the first end 31 and the first end 31 itself of the second strip 30 are rounded. In some embodiments, see FIGS. 3A, 4, 8A and 8B, the first part 33 and the first end 31 are rounded in a corresponding way or shape as the orifice 23 of the first strip 20 for easy fitting and introduction and threading of the second strip 30 into and past the orifice into the slit 25 of the first strip.

Figure 3B:
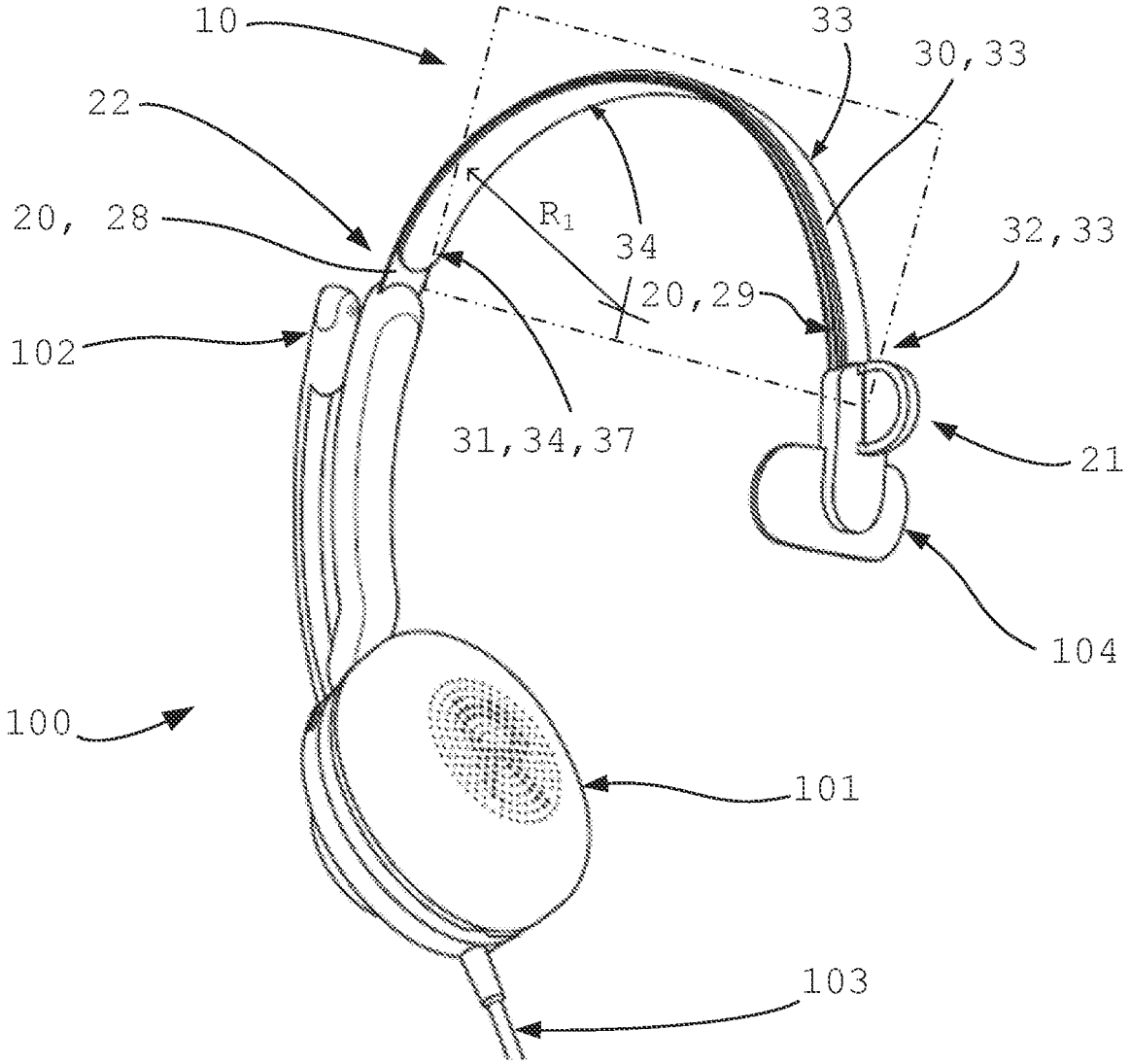
FIG. 3B shows a perspective view of the example headset of FIG. 3A before disassembly or after assembly of the two parts or strips making up the whole headband when assembled together according to an embodiment of the present disclosure.
Figure 5A:
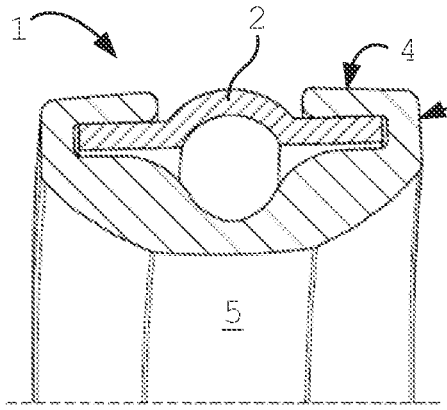
FIGS. 5A and 5B show cross-section views across assembled prior art headbands.
Figure 5B:
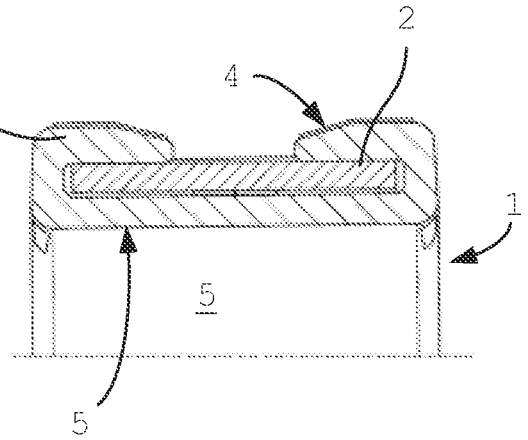
Figure 3C:
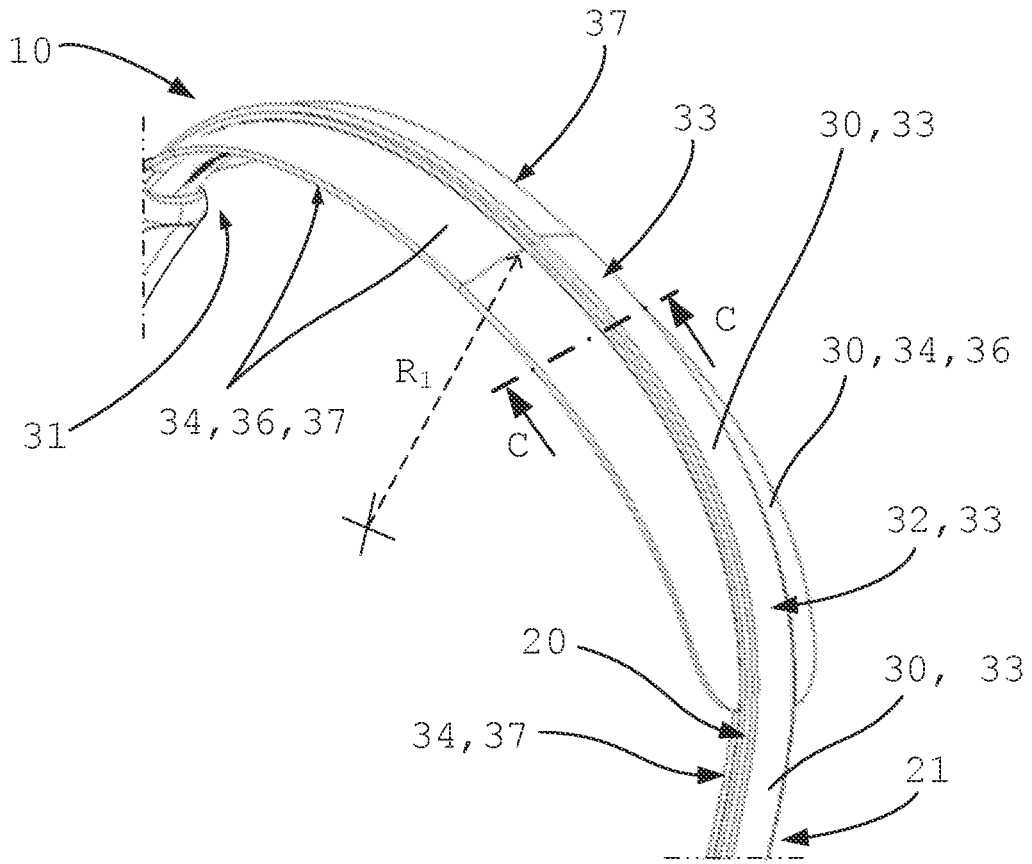
FIG. 3C shows a perspective view of a cutout section of the example headset according to the double-dotted box of FIG. 3B before disassembly or after assembly of the two parts or strips making up the whole headband when assembled together according to an embodiment of the present disclosure.

In some embodiments, the width $W_2$ of the second part 34 of the second strip 30 is at least 1% to 400% or 5% to 300% or 10% to 200% larger or wider than the breadth or width $W_3$ of the first strip 20 in a plane of extension of the first and the second strip along at least a longitudinal section 36 of the second strip, see FIG. 3C being a view according to the box with double-dotted line in FIG. 3B. This longitudinal section 36 is configured to be born against the head of a user of the headband 10 when the first and the second strip are assembled together making up the headband as in FIG. 3C corresponding to the embodiments of FIGS. 1, 2 and 3B. This longitudinal section 36 of the second strip 30 is in some embodiments shaped similar to a wing bent somewhat downwards, see FIGS. 6B and 6C, with outer edges 37 facing downwards.

Figure 7:
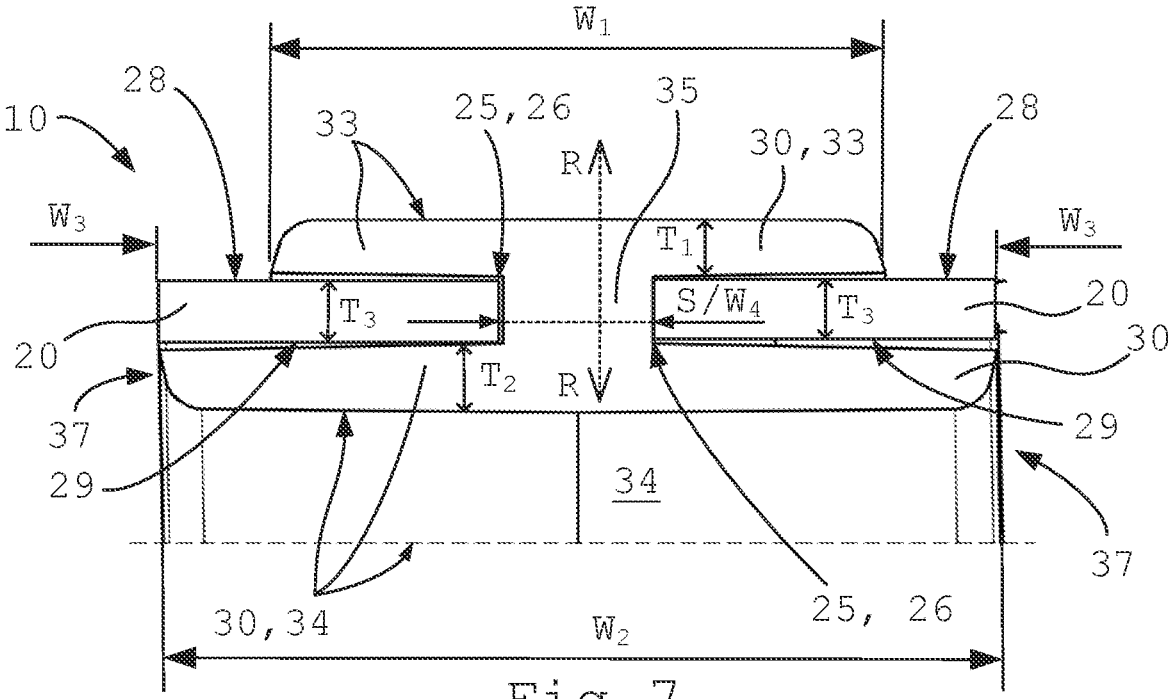
Figure 8A:
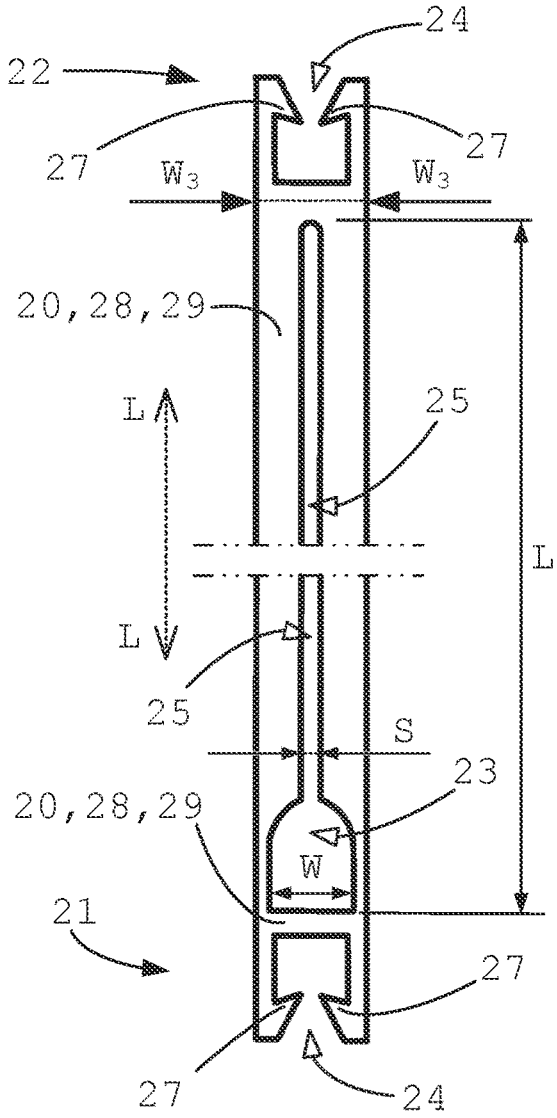
FIGS. 8A and 8B are plane views from above of sheets being examples of first parts or first strips of the two parts or strips configured to make up a whole headband according to embodiments of the present disclosure.
Figure 8B:
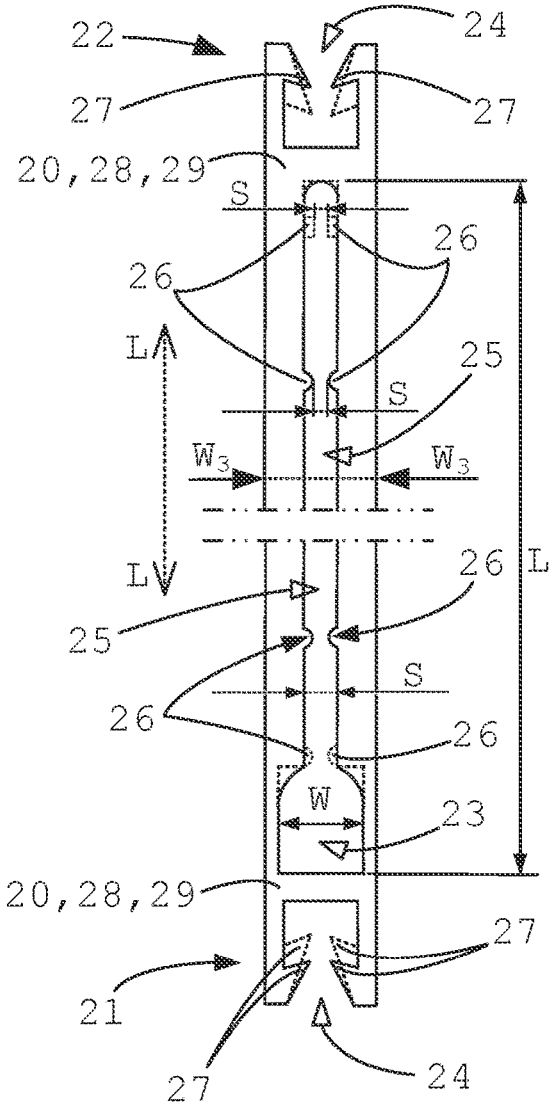

In FIGS. 1, 2, 3A, 4, 6, 7, 8A and 8B, double arrows with reference signs R and L define directions of movement and introduction of the second strip 30 of the headband 10 in relation to the first strip 20 of the headband when assembling the second strip to the first strip. This is done by firstly aligning the first end 31 of the second strip 30 with the orifice 23 and then inserting the second strip via and through the orifice 23 from either the first or top or upper surface 28 of the first strip 20 or the second or bottom or lower surface 29 of the first strip and then into the slit 25 and through the slit until the full length of the second strip is inserted and slid over the first strip, i.e. until the first end 31 has reached the end of the slit 25 being closer to the second end 22 of the first strip 20 than the orifice 23 and the second end 32 of the second strip 30 has reached and the first part 33 of the second strip has been fully inserted through the orifice 23 and the thickness of the first strip 20 and reached either the first or top or upper surface 28 of the first strip 20 or the second or bottom or lower surface 29 of the first strip. As seen in FIGS. 8A and 8B, the first strip 20 can receive the second strip 30 from any of its sides or surfaces 28 or 29, hence, it does not matter from which of its sides or surfaces 28 or 29 the second strip is inserted as long as this is done before assembly of any other entity or accessory 100, 101, 102, 103 or 104 at any of the ends 21, 22 of the first strip 20 as the headband 10, only made up by the two pieces or two strips 20, 30, may be turned upside down depending on which sides or surfaces 28 and 33 or 29 and 34 that are to be exposed or born against the users head. The double arrow R-R of FIGS. 1, 2, 3A, 6 and 7 visualizes two opposite and possible directions of insertion as a first direction R and step of assembly of the second strip 30 into the first strip 20 to make up the headband 10 and the double arrow L-L in FIGS. 1, 2, 3A, 4, 8A and 8B visualizes two opposite and possible directions of a subsequent or second direction L and step of assembly of the second strip 30 into the first strip 20 to make up the headband 10 or a subsequent or third direction L and step of disassembly of the second strip 30 from the first strip 20 to disengage the strips of the headband 10. The first direction R is performed substantially perpendicular or perpendicular to the longitudinal extension of the first strip 20 and the second direction L is performed substantially in parallel with or in parallel with the longitudinal extension of the first strip 20. The reference sign L in FIGS. 8A and 8B also represent the total length L of the through opening of the first strip 20 comprising the orifice 23 and the slit 25. The directions R and L represent in some embodiments the disassembly of the headband 10 by detaching the second strip 30 from the first strip 20. In some embodiments, this detachment is done to change appearance of the headband 10 by replacing the second strip 30 with another second strip with different design, such as color, material, structure and/or texture, or to repair the headband by replacing a broken second strip with a new integral one or the like. The assembly/disassembly is very easy to do as it is only two parts or pieces 20, 30 (making up the headband 10) that have to be handled.

In some embodiments, see FIGS. 3A, 4, 6, 7, 8A and 8B, the first part 33 of the second strip 30 has a size and/or shape and/or width W adapted to fit into and pass through the orifice 23 of the first strip 20. In an embodiment, see FIGS. 3A, 4, 6, 7, 8A and 8B, the first part 33 of the second strip 30 has a size and/or shape and/or width W adapted to not fit into and through the slit 25 of the first strip 20 when assembled thereto in the first direction R across the plane of extension of the first strip. In an embodiment, see FIGS. 3A, 4, 6, 7, 8A and 8B, the first part 33 of the second strip 30 has a size and/or shape and/or width W adapted to fit into and pass through the slit 25 of the first strip 20 when moved in a subsequent second direction L along the plane of extension of the first strip. In some embodiments, see FIGS. 3A, 4, 6 and 7, the second part 34 of the second strip 30 has a size and/or shape adapted to neither fit into or pass through the orifice 23 of the first strip 20 nor the slit 25 of the first strip 20 when assembled thereto in the same first and second directions R, L of assembly.

In some embodiments, see FIGS. 1, 2, 3B, 6 and 7, the first part 33 of the second strip 30 covers a substantial and/or major part of a first surface 28 of the first strip 20 when assembled thereto. In some embodiments, see FIGS. 1, 2, 3B, 6 and 7, the second part 34 of the second strip 30 covers a substantial and/or major part of a second surface 29 of the first strip 20 when the strips are assembled together. In some embodiments, see FIGS. 1, 2, 3B, 6 and 7, these first and second surfaces 28, 29 of the first strip 20 are opposite and face away from each other. In some embodiments, see FIGS. 1, 2, 3B, 6 and 7, the first and second parts 33 and 34 of the second strip 30 and the first and second surfaces 28 and 29 of the first strip 20 form the exposed surfaces of the headband 10 when assembled.

In some embodiments, see FIGS. 1, 2, 3B, 6 and 7, the first part 33 of the second strip 30 covers a substantial and/or major part or the whole part or area of the first surface 28 of the first strip 20 when the strips 20, 30 are assembled together as the headband 10. In some embodiments, see FIGS. 1, 2, 3B, 6 and 7, the second part 34 of the second strip 30 covers a substantial and/or major part or the whole part or area of the second surface 29 of the first strip 20 when the strips 20, 30 are assembled together as the headband 10. In some embodiments, see FIGS. 1, 2, 3B, 6 and 7, the first part 33 of the second strip 30 covers a substantial and/or major part or the whole part or area of the first surface 28 of the first strip 20 and the second part 34 of the second strip 30 covers a substantial and/or major part or the whole part or area of the second surface 29 of the first strip 20 when the strips 20, 30 are assembled together as the headband 10. In some embodiments, see FIGS. 4, 6 and 7, the first part 33 of the second strip 30 of the headband 10 covers a part or area of the first surface 28 of the first strip 20 of the headband 10 being smaller or less than the corresponding part or area of the second surface 29 of the first strip 20 being covered by the second part 34 of the second strip 30 when the strips are assembled together as the headband. In some embodiments, see FIGS. 4, 6 and 7, the second part 34 of the second strip 30 of the headband 10 covers a part or area of the second surface 29 of the first strip 20 of the headband being larger than the corresponding part or area of the first surface 28 of the first strip 20 being covered by the first part 33 of the second strip 30 when the strips are assembled together as the headband.

In some embodiments, see FIGS. 1, 2, 3A to 3C, 4 to 4B, 6 to 6D and 7, the first and second surfaces 28, 29 of the first strip 20 of the headband 10 are opposite and face away from each other and/or are exposed in opposite directions and/or form part of outer/exposed opposite surfaces of the headband 10 when its second strip 30 is detachably assembled to the first strip to make up the whole headband. In some embodiments, see FIGS. 1, 2, 3B, 3C, 4, 6 to 6D and 7, the second strip 30 comprises first and second surfaces of its the first and second parts 33, 34 that are opposite and face away from each other and/or are exposed in opposite directions and/or form part of outer/exposed opposite surfaces of the headband 10 when the second strip is detachably assembled to the first strip 20 to make up the whole headband. In some embodiments, see FIGS. 6 to 6D and 7, the second strip 30 comprises first and second surfaces of its first and second parts 33, 34 that are opposite and face away from each other and/or are exposed in opposite directions and/or form part of outer/exposed opposite surfaces of the headband, which first and second surfaces and parts 33, 34 of the second strip 30 are exposed to a larger extent and with a larger area than the first and second surfaces 28 and 29 of the first strip 20 of the headband that are exposed when the second strip is detachably assembled to the first strip to make up the whole headband.

In an embodiment, see FIGS. 6 to 6D and 7, the size and/or shape and/or width $W_4$ of the third part 35 of the second strip 30 is/are configured to fit into and pass through the orifice 23 and the slit 25 of the first strip 20 when assembled thereto in the first R and the second direction L to make up the whole headband 10. In some embodiments, see FIGS. 3A, and 4 to 4B, the first part 33 of the second strip 30 are larger/wider than the slit 25 but smaller than the orifice 23, i.e. not as wide as the orifice 23 of the first strip 20 in the plane of extension of the first and the second strips. In some embodiments, see FIGS. 3A, 4 to 4B, 6 to 6D and 7, the second part 34 of the second strip 30 are larger and/or wider than both the orifice 23 and the slit 25 of the first strip 20 in the plane of extension of the first and the second strips 20, 30. In some embodiments, see FIGS. 4, 6A to 6D, 7, and 8A, the slit 25 of the first strip 20 has the same width and/or size and/or shape S along its length L. In some embodiments, see FIGS. 3A, 6, 7, and 8B, the slit 25 of the first strip 20 has a varying width and/or size and/or shape S along its length L. In some embodiments, see FIGS. 3A, 6, 7 and 8B, the slit 25 of the first strip 20 comprises at least one protrusion 26 narrowing down the width and/or size S of the slit where the protrusion(s) is/are located.

In some embodiments, see FIGS. 1, 2, 3A, 4, 8A and 8B, the first strip 20 comprises the first end 21 and the second end 22 and at least one of these ends comprises a recess 24 with an opening facing away from the first strip. The recess 24 is made through the thickness $T_3$ of the first strip 20. In some embodiments, see FIGS. 8A and 8B, each end 21, 22 of the first strip 20 comprises the recess 24. In some embodiments, see FIGS. 1, 2, 3A, 4, 8A and 8B, each recess 24 of the first strip 20 comprises at least one projection 27 extending inwards towards the first strip 20 or each recess 24 comprises two projections 27 extending inwards towards the first strip 20. In some embodiments, see FIGS. 1, 2, 3A, 4, 8A and 8B, each projection 27 at/in the ends 21, 22 of the first strip 20 is pointed. In some embodiments, see FIGS. 1, 2, 3A, 4, 8A and 8B, each projection 27 of the recess 24 of the first strip 20 is shaped as a pointed hook. In some embodiments, see FIGS. 1, 2, 3A, 4, 8A and 8B, the two projections 27 of the recess 24 of the first strip 20 together form a double hook with points that extend inwards at an angle towards the recess and the strip 20.

Figure 4:
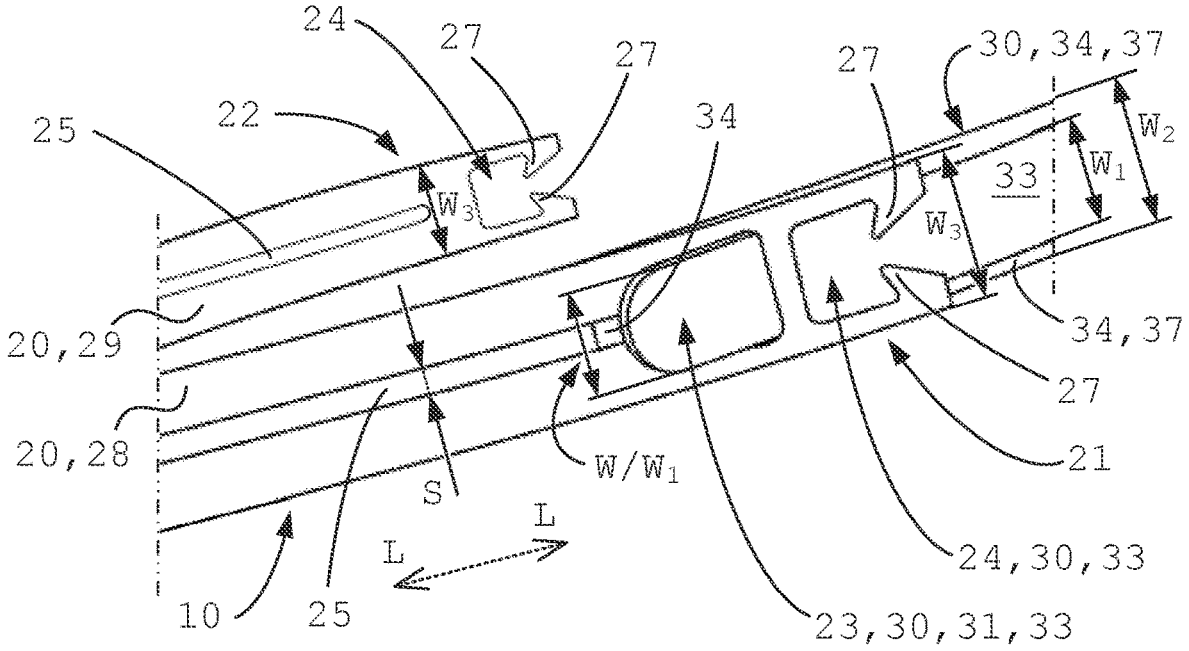
FIG. 4 shows a perspective view from above of an example headband during assembly/disassembly of the two parts or strips to make up the whole headband according to an embodiment of the present disclosure.

In some embodiments, see FIGS. 4, 8A and 8B, the slit 25 and its orifice 23 of the first strip 20 are configured to extend between the first and second ends 21, 22 of the first strip and to end before each recess 24.

In some embodiments, see FIGS. 3A, 6, 7, 8A and 8B, the slit 25 and/or the orifice 23 of the first strip 20 comprises one or more areas or sections or portions of roughness and/or unevenness and/or one or more teeth 26 along the inner surface of the inner circumference of the slit 25 being configured to be in contact with at least parts of the second strip 30. In some embodiments, the one or more areas or sections or portions of roughness and/or unevenness and/or one or more teeth 26 along the inner surface of the circumference of the slit 25 is/are configured to be in contact with at least parts of the third part 35 interconnecting the first and second parts 33, 34 of the second strip 30.

In some embodiments, see FIGS. 8A and 8B, the length L between the ends of the slit 25 and the orifice 23 (i.e. the total length L from where the orifice 23 begins until the slit 25 ends or vice versa) of the first strip 20 is substantially the same or the same or substantially equal or equal or longer than the length of the second strip 30. In some embodiments, the length of the first part 33 of the second strip 30 is substantially the same or the same or substantially equal or equal or longer or shorter than the length of the second part 34 of the second strip 30. In some embodiments, see FIGS. 1, 2, 3B, 4, 6 and 7, the first part 33 of the second strip 30 is substantially aligned lengthwise (longitudinally/in the longitudinal direction) with the second part 34 of the second strip or aligned lengthwise (longitudinally/in the longitudinal direction) with the second 34 part of the second strip. In some embodiments, see FIGS. 1, 2, 3B, 4, 6 and 7, the first part 33 of the second strip 30 is substantially aligned laterally or across the length of the second strip 30 (across the longitudinal direction of the second strip) with the second part 34 of the second strip or aligned laterally or across the length of the second strip 30 (across the longitudinal direction of the second strip) with the second part 34 of the second strip. In some embodiments, see FIGS. 4, 6 and 7, the first part 33 and the second part 34 of the second strip 30 is almost symmetrically or symmetrically overlaid each other and/or as seen in the plane of extension of the second strip in FIGS. 6 and 7. In some embodiments, see FIGS. 4 to 4B, 6 to 6D and 7, the first part 33 of the second strip 30 has a smaller width $W_1$ or breadth than the width $W_2$ or breadth of the second part 34 of the second strip. In some embodiments, see FIGS. 4, 6 to 6D and 7, the first part 33 of the second strip 30 does not fully overlay the second part 34 of the second strip when seen in the direction of extension of the second strip or the headband shown in FIGS. 6 to 6D and 7 and/or as seen in FIGS. 4 to 4B, 8A and 8B.

The second aspect of this disclosure concerns a headset 100 comprising a headband 10 according to any of the embodiments of the present disclosure. In some embodiments, the headband 10 is detachably connected with one end 21, 22 to only a headset speaker 101 or the headband is detachably connected with one end to a headset speaker and a headset microphone 102 or detachably connected with one end to a head support 104.

Figure 4A:
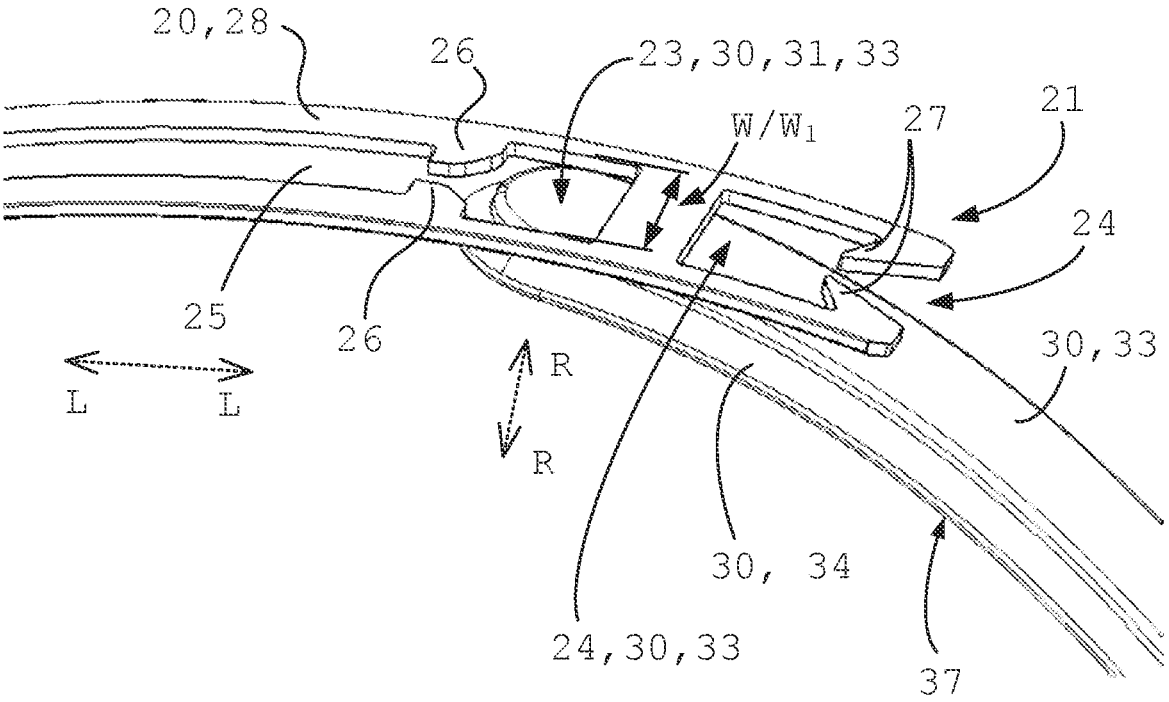
FIG. 4A shows a perspective view from above of an example headband during assembly/disassembly of the two parts or strips to make up the whole headband according to an embodiment of the present disclosure.
Figure 4B:
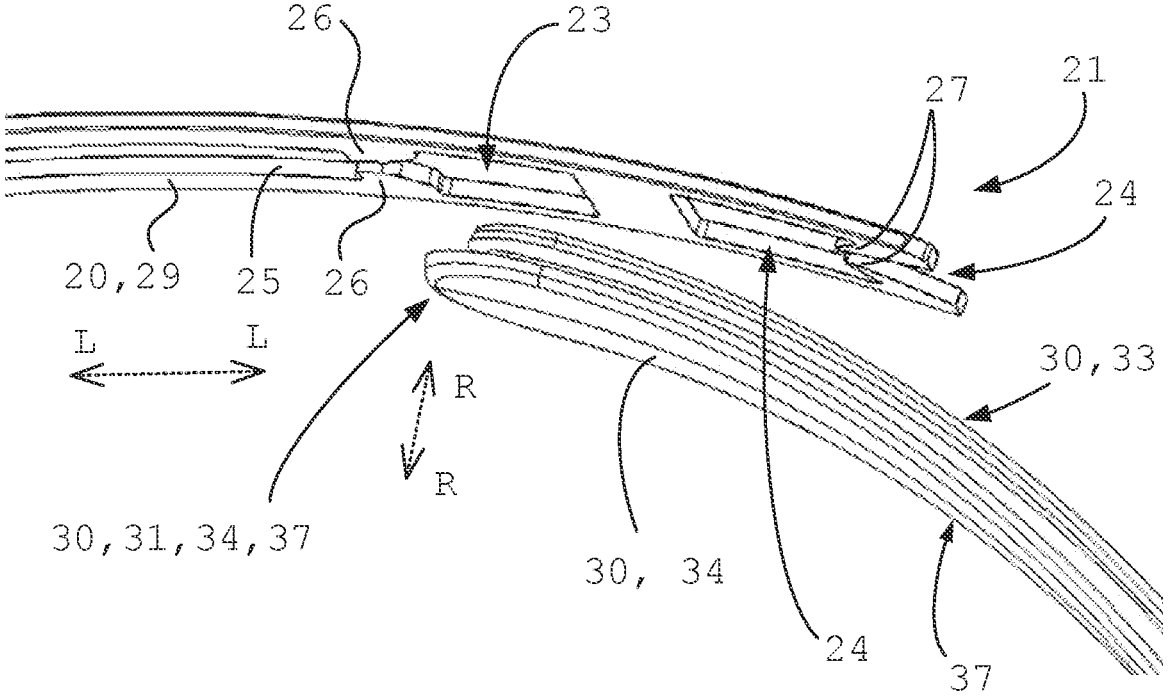
FIG. 4B shows a perspective view from below of an example headband during assembly/disassembly of the two parts or strips to make up the whole headband according to an embodiment of the present disclosure.

The third aspect of this disclosure shows a method for assembly of a headband 10 for a headset 100 or a headphone 100. The method comprises assembling the headband 10 by assembling a first strip 20 and second strip 30 detachably together, see FIGS. 4, 4A and 4B. The first strip 20 comprises a through hole comprising the orifice 23 and the slit 25 through which the second strip 30 is partly thread/inserted. The second strip 30 comprises the first part 33 and the second part 34, which first part 33 is smaller than or not as wide as the orifice 23 of the first strip 20 but larger than or not as narrow as the slit 25 of the first strip, such that the first part 33 at the first end 31 of the second strip is able to be moved through the orifice 23 of the through hole and the thickness $T_3$ of the first strip 20 in the first direction R but the second part 34 of the second strip 30 is larger or wider than the orifice 23 and cannot be moved through the orifice and the first strip 20 in the first direction R. Hence, the first part 33 and the second part 34 are thread over the first strip 20 along the two different and opposite surfaces 28 and 29 of the first strip, while the interconnecting middle part 35 of the second strip 30 moves through the slit 25 until the end and length L of the slit is reached (see FIGS. 8A and 8B) along the second/subsequent direction L and the first part 33 of the second end 32 of the second strip has passed through the orifice 23 and the thickness $T_3$ of the first strip 20. Any disassembly are done in the reverse order, i.e. the first part 33 at the second end 32 of the second strip 30 is moved through the orifice 23 and the thickness $T_3$ of the first strip 20 and then is the remaining length of the second strip moved through the slit 25 along its length L until the first end 31 of the second strip 30 reaches the orifice 23 of the first strip and is removed therethrough its thickness $T_3$ and from the first strip. Hence, at assembly of the headband 10, the second strip 30 is inserted via at least one through opening 23, 25 of the first strip 20 into and past/through its thickness $T_3$ and over the first strip detachably to at least partly cover the first strip with first and second parts 31, 32, 33, 34. This is accomplished by aligning the first part 31, 33 of the second strip 30 with the orifice 23 of the through opening of the first strip 20 at the first end 21 of the first strip, then moving the second strip 30 in the first direction R across the plane of extension of the first strip 20, such that the first part 31, 33 of the second strip is moved into the orifice 23 and through the orifice and the through opening and the thickness $T_3$ in the first direction R and into the slit 25 ending closer to/at the second end 22 of the first strip; and moving the second strip 30 in a subsequent second direction L along the plane of extension and the length of the first strip 20 along the length L of the slit 25 until the end of the slit with the first or upper part 33 of the second strip moving along and over the first or upper side 28 or the second or lower side 29 of the first strip, while, at the same time, moving the second or lower part 34 of the second strip 30 along and over the second or lower side 29 or the first and upper side 28 of the first strip (depending on from which side 28 or 29 of the first strip the second strip is inserted) until the end of the slit 25 is reached finalizing the assembly of the headband 10.

In some embodiments, the method comprises moving the first part 31, 33 of the second strip 30 along and over the first or upper side 28 of the first strip 20 being opposite the second or lower side 29 of the first strip, which opposite and second or lower side of the first strip 20 the second or lower part 34 of the second strip is moving over and along simultaneously until the assembly of the two strips together is finished to make up the headband 10.

In some embodiments, the method comprises moving the first part 31, 33 of the second strip 30 along and over the second or lower side 29 of the first strip 20 being opposite the first and upper side 28 of the first strip, which opposite and first or upper side of the first strip 20 the second or lower part 34 of the second strip is moving over and along simultaneously until the assembly of the two strips together is finished to make up the headband 10.

In some embodiments, the method comprises conforming the assembled headband 10 to the shape of a head of one or more users. In some embodiments, the method comprises conforming the first strip 20 to the shape of a head of one or more users before assembly of the second strip 30 into the headband 10. In some embodiments, the method comprises conforming the second strip 30 to the shape of a head of one or more users before assembling the second strip to the first strip 20 to make up the headband 10. In some embodiments, the method comprises conforming the first and the second strip 20, 30 to the shape of a head of one or more users before assembly together as the headband 10. In some embodiments, the method comprises conforming the first strip 20 and the second strip 30 to each other and to the shape of a head of one or more users before assembly into the headband 10. This conforming of the headband 10 to a user's head (i.e. to the shape and/or curvature and/or radius of the head) is visualized by arrows $R_1$ in FIGS. 1, 2, 3B and 3C in a plane substantially in parallel or in parallel with the length of the headband 10 and visualized by arrows $R_2$ in FIGS. 6B and 6C in a plane substantially perpendicular to or perpendicular to the length of the headband 10. Hence, in some embodiments, see FIGS. 6B and 6C, the headband 10 is rounded and/or bent in two perpendicular planes to better fit to a user's head when the headband is born. The edges 37 of the headband 10, i.e. the outer edges 37 of the second part 34 of the second strip 30 are in FIGS. 6B and 6C visualized in two different embodiments, a more squared end shape in solid lines and a more rounded end shape in dotted lines.

In some embodiments, see FIGS. 1, 2 and 3B, the second strip 30 has its first end 31 and interconnecting part 35 at that first end 31 ending and abutting against the end of the slit 25 of the first strip 20 when the headband 10 is finally assembled. In some embodiments, see FIGS. 1, 2 and 3B, the second strip 30 has its second end 32 and interconnecting part 35 at that second end 32 ending and abutting against one end of the orifice 23 when the headband 10 is finally assembled. In some embodiments, see FIGS. 1, 2 and 3B, the second strip 30 has both its ends 31 and 32 and its interconnecting part 35 at each of these ends ending and abutting against the ends of the slit 25 and the orifice 23, respectively. This provides a secure holding of the second strip 30 to the first strip 20. In some embodiments, if to disassemble the second strip 30 from the first strip 20, the second end 32 of the second strip 30 is moved in a direction R being opposite the first direction R (see FIGS. 1, 2, 3A, 6 and 7) when assembling the second strip, such that the first part 33 is pushed from the first side 28 or second side 29 of the first strip 20 through the orifice 23 and the thickness of the first strip 20 out of the orifice 23 and below the second side 29 or the first side 28, and then the second strip 30 is further pulled or pushed in a direction L being opposite the first direction L shown pointing upwards and towards the second end 22 of the first strip 20 in FIGS. 1, 2, 3A, 8A and 8B when assembling the second strip 30 to the first strip 20, i.e. the second strip 30, when disassembled from the first strip 20, is moved in the direction of arrow L pointing downwards and towards the first end 21 of the first strip and towards the orifice 23 in FIGS. 1, 2, 3A, 8A and 8B until the first end 31 of the second strip 30 exits the orifice 23.

The person skilled in the art realizes that the present disclosure is not limited to the preferred embodiments described above. The person skilled in the art further realizes that modifications and variations are possible within the scope of the appended claims. Additionally, variations to the disclosed embodiments can be understood and effected by the skilled person in practicing the claimed disclosure, from a study of the drawings, the disclosure, and the appended claims.

LIST OF REFERENCES

1 Prior art headband
2 Metal strip of prior art headband
3 Plastic coverage of prior art headband
4 First/Top/Upper surface/part of prior art headband cover 3
5 Second/Bottom/Lower/surface/part of prior art headband cover 3
10 Head band of an embodiment/aspect of the invention
11 First end of headband 10
12 Second end of headband 10
20 First metal/wood/plastic strip of inventive headband 10
21 First end of first strip 20
22 Second end of first strip 20
23 One/First(/Large) opening/hole/orifice/through hole made/punched/cut through the thickness of first strip 20 or made by moulding first strip 20
24 Another/Second/Third(/Small) opening/recess made/punched/cut through the thickness of first strip 20 or made by moulding first strip 20
25 Slit/Slot being made/punched/cut through the thickness of first strip 20 or being made by moulding first strip 20 and extending at least partly along first strip 20
26 Protrusion/Tooth/Teeth or narrowing part/section/portion of the slit/slot 25
27 Projection/Hook/Point of first strip 20 extending inwards towards first strip 20
28 First/Top/Upper surface/part of first strip 20
29 Second/Bottom/Lower surface/part of first strip 20
30 Second plastic and/or metal and/or wood and/or fabric and/or laminate and/or composite coverage/cover/wrapper/wrapping/wrappage/cover strip of headband 10
31 First end of second headband strip/cover 30
32 Second end of second headband strip/cover 30
33 First/Top/Upper surface/part of second headband strip/cover 30
34 Second/Bottom/Lower surface/part of second headband strip/cover 30
35 Third/Middle/Waist part of second headband strip/cover 30
36 Section of second part 34 along the length/longitudinal direction of second strip 30
37 Ends of second part 34 along the length/longitudinal direction of second strip 30
100 Headset/-phone/Earphone/-cup (wireless or with wire)
101 Headset/-phone/Earphone/-cup speaker
102 Headset/-phone/Earphone/-cup microphone
103 Headset/-phone/Earphone/-cup wire
104 Head support of headset/-phone/earphone/-cup
L: Length of slit 25 and orifice 23. S: Size/Shape/Span/Width of slit 25.
$T_1$: Thickness of first part 33 of second strip 30. $T_2$: Thickness of second part 34 of second strip 30. $T_3$: Thickness of first strip 20.
W: Size/Shape/Span/Width of orifice 23. Size/Shape/Span/Width of first part 33 of second strip 30. $W_2$: Size/Shape/Span/Width of second part 34 of second strip 30. $W_3$: Size/Shape/Span/Width of first strip 20. $W_4$: Size/Shape/Span/Width of third part 35 of second strip 30.

The invention claimed is:

1. A headband for a headset or headphone, the headband being configured to carry an earcup, the headband comprising a first strip and a second strip detachably assembled together, wherein the first strip comprises at least one through opening and the second strip is detachably connected via at least one of the through openings to the first strip being a carrier, wherein the second strip comprises first and second parts at least partly covering the first strip, wherein the through opening of the first strip is configured to extend along the first strip with a varying size and/or shape and/or width from an orifice at a first end of the first strip into a slit ending closer a second end of the first strip, that the first part of the second strip has a size and/or shape and/or width adapted to fit into the orifice of the through opening when assembled thereto in a first direction across the first strip, that the size and/or shape and/or width of the first part of the second strip is adapted to not fit into the slit when assembled thereto in the first direction and that the second part of the second strip has a size and/or shape and/or width adapted to neither fit into the orifice nor the slit of the first strip when assembled thereto to finalize the headband.

2. The headband according to claim 1, wherein the size and/or shape and/or width of the second part of the second strip is adapted to neither fit into or pass through the orifice nor the slit of the first strip when assembled thereto in the same first direction or any other direction of assembly.

3. The headband according to claim 1, wherein the first part of the second strip covers a substantial/major part of a first surface of the first strip and the second part of the second strip covers a substantial/major part of a second surface of the first strip when the strips are assembled together, which first and second surfaces of the first strip are opposite and face away from each other.

4. The headband according claim 1, wherein the first and second parts of the second strip are interconnected via a third part with a size and/or shape and/or width adapted to fit into and pass through the orifice and the slit of the first strip when assembled thereto.

5. The headband according to claim 4, wherein the third part of the second strip is configured to fit into and pass through the orifice and the slit of the first strip when assembled thereto in the first direction and a subsequent second direction along a plane of extension of the first strip.

6. The headband according to claim 1, wherein the first part of the second strip are larger/wider than the slit but smaller than the orifice of the first strip in a plane of extension of the first and the second strip.

7. The headband according to claim 1, wherein the second part of the second strip are larger/wider than both the orifice and the slit of the first strip in a plane of extension of the first and the second strip.

8. The headband according to claim 1, wherein the slit of the first strip has the same width and/or size and/or shape along its length.

9. The headband according to claim 1, wherein the slit of the first strip has a varying width and/or size and/or shape along its length.

10. The headband according to claim 9, wherein the slit of the first strip comprises at least one protrusion narrowing down the width and/or size of the slit where the protrusion is located.

11. The headband according to claim 1, wherein at least one of the ends of the first strip comprises a recess with an opening facing away from the first strip, which recess is made through the thickness of the first strip.

12. The headband according to claim 11, wherein each end of the first strip comprises the recess.

13. The headband according to claim 11, wherein each recess comprises at least one projection extending inwards towards the first strip.

14. The headband according to claim 11, wherein each recess comprises two projections extending inwards towards the first strip.

15. The headbands according to claim 13, wherein each projection is pointed.

16. The headband according to claim 13, wherein each projection is shaped as a pointed hook.

17. The headband according to claim 11, wherein the slit and the orifice of the first strip are configured to extend between the first and second ends of the first strip and to end before each recess of the first strip.

18. The headband according to claim 11, wherein the slit and/or the orifice of the first strip comprises one or more areas or sections or portions of roughness and/or unevenness and/or one or more teeth along the inner surface of the circumference being configured to be in contact with at least parts of the second strip.

19. The headband according to claim 11, wherein the length between the ends of the slit and the orifice of the first strip is substantially the same or the same or substantially equal or equal or longer than the length of the second strip of the headband.

20. The headband according to claim 11, wherein the first strip is made of metal or plastic, such as Thermoplastic Polyurethane (TPU), or wood or a composite material or made of a combination of one or more or any of those materials.

21. The headband according to claim 20, wherein the second strip is made of plastic, such as Thermoplastic Polyurethane (TPU), or wood or a composite material or fabric or made of a combination of one or more or any of those materials.

22. The headband according to claim 7, wherein the second part of the second strip has a breadth or width being smaller or substantially the same or the same or larger than the breadth or width of the first strip in a plane of extension of the first and the second strip.

23. The headband according to claim 22, wherein the width of the second part of the second strip is at least 5% smaller or at least 1% to 400% larger than the breadth or width of the first strip in a plane of extension of the first and the second strip.

24. The headband according to claim 22, wherein the width of the second part of the second strip is at least 1% to 400% larger than the breadth or width of the first strip in a plane of extension of the first and the second strip along at least a longitudinal section of the second strip, which longitudinal section is configured to be born against the head of a user of the headband when the first and the second strip are assembled together making up the headband.

25. A method for assembly of a headband for a headset, the method comprising assembling the headband by assembling a first strip and a second strip detachably together via at least one through opening of the first strip by detachably connecting the second strip to the first strip via the at least one through opening to at least partly cover the first strip with first and second parts of the second strip when the headband is assembled, wherein by aligning the first part of the second strip with an orifice of the through opening of the first strip at a first end of the first strip, moving the second strip in a first direction across the first strip such that the first part of the second strip is moved into the orifice and through the orifice and the through opening in the first direction and into a ending closer a second end of the first strip, and moving the second strip in a subsequent second direction along the first strip along the until the end of the slit with the first part of the second strip moving along and over a first side of the first strip while, at the same time, moving the second part of the second strip along and over a second side of the first strip until the end of the slit is reached finalizing the assembly of the headband.

26. The method according to claim 25 comprising moving the first part of the second strip along and over the first side of the first strip being opposite the second side of the first strip, which opposite and second side the second part of the second strip is moving over and along simultaneously and in parallel with the first part of the second strip until the assembly of the two strips together as the headband is finished.

* * * * *